US011422498B2

(12) United States Patent
Takayama

(10) Patent No.: US 11,422,498 B2
(45) Date of Patent: Aug. 23, 2022

(54) SHEET CONVEYING APPARATUS, SHEET COOLING APPARATUS AND IMAGE FORMING SYSTEM

(71) Applicant: CANON KABUSHIKI KAISHA, Tokyo (JP)

(72) Inventor: Hiroki Takayama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/318,012

(22) Filed: May 12, 2021

(65) Prior Publication Data

US 2021/0373459 A1 Dec. 2, 2021

(30) Foreign Application Priority Data

May 29, 2020 (JP) ..... JP2020-094049

(51) Int. Cl.
*G03G 21/16* (2006.01)
*G03G 15/00* (2006.01)

(52) U.S. Cl.
CPC ..... *G03G 21/1619* (2013.01); *G03G 15/6573* (2013.01); *G03G 21/1647* (2013.01); *G03G 21/1695* (2013.01)

(58) Field of Classification Search
CPC ..... G03G 21/1619; G03G 21/1647; G03G 21/1695; G03G 15/6573; E05D 2003/027; E05D 2003/022
USPC ..... 16/262
See application file for complete search history.

(56) References Cited

U.S. PATENT DOCUMENTS

| | | | | |
|---|---|---|---|---|
| 5,896,472 | A | 4/1999 | Takayama | |
| 6,647,218 | B2 | 11/2003 | Takayama | |
| 9,904,228 | B2 | 2/2018 | Xie et al. | |
| 10,649,393 | B2 | 5/2020 | Iwamoto | |
| 2013/0283567 | A1* | 10/2013 | Yamaguchi | E05D 3/02 16/260 |
| 2019/0187607 | A1 | 6/2019 | Iwamoto | |
| 2021/0070539 | A1* | 3/2021 | Chasteen | B65D 19/06 |

FOREIGN PATENT DOCUMENTS

JP 2019-105812 A 6/2019

* cited by examiner

*Primary Examiner* — Arlene Heredia
(74) *Attorney, Agent, or Firm* — Venable LLP

(57) ABSTRACT

Disclosed is a sheet conveying apparatus which includes a rotating member rotatably supported with respect to a frame by a first hinge and a second hinge such that the rotating member is rotatable between a first position where a conveying member for conveying a sheet is covered and a second position where the conveying member is exposed. In the horizontal direction, a position where a first portion of the first hinge is arranged is substantially the same as that of a third portion of the second hinge, and a fourth portion of the second hinge is arranged with respect to the second portion of the first hinge such that a center position of a second scale is located at a position farther from a gravity center of the rotating member than a center position of a first scale.

7 Claims, 7 Drawing Sheets

SHEET CONVEYING APPARATUS, SHEET COOLING APPARATUS AND IMAGE FORMING SYSTEM

BACKGROUND OF THE INVENTION

Field of the Invention

The present invention relates to a sheet conveying apparatus which conveys a sheet, a cooling apparatus with the sheet conveying apparatus and an image forming system with the sheet conveying apparatus.

Description of the Related Art

An image forming apparatus is a typical apparatus equipped with a sheet conveying apparatus. In such an image forming apparatus, the configuration is widely known in which an opening/closing member is moved from a closed position to an open position to expose conveying members that convey a sheet when performing maintenance processing or jam processing by which a sheet jam is cleared. Japanese Patent Application Laid-Open No. 2019-105812 describes a configuration in which an opening/closing member is rotatably supported via a plurality of hinges by a frame of an image forming apparatus and the opening/closing member moves between a closed position and an open position by rotating.

When the configuration is adopted where the opening/closing member is rotatably supported by the frame via hinges, as in the configuration of Japanese Patent Application Laid-Open No. 2019-105812, there is a possibility that the opening/closing member is supported in a tilted state with respect to the frame due to the effect of the weight of the opening/closing member. This will be described below using FIGS. 7A and 7B.

FIGS. 7A and 7B are each a schematic view of the opening/closing member 260 (rotating member) and the frame 240. FIG. 7A is a diagram in a case where it is assumed that the weight of the opening/closing member 260 is zero. FIG. 7B is a diagram in a case where the weight of the opening/closing member 260 is taken into consideration. In FIGS. 7A and 7B, the opening/closing member 260 is located at a closed position.

As shown in FIG. 7, the opening/closing member 260 is attached to the frame 240 via two hinges 264*a* and 264*b*. The hinge 264*a* has the exterior fixed portion 264*a*1 fixed to the opening/closing member 260, the frame fixed portion 264*a*2 fixed to the frame 240, and the hinge pin 264*a*3. Hinge holes (not shown) through which the hinge pin 264*a*3 is inserted are formed on the exterior fixed portion 264*a*1 and on the frame fixed portion 264*a*2.

The hinge 264*b* is attached below the hinge 264*a* in the vertical direction. The hinge 264*b* has the exterior fixed portion 264*b*1 fixed to the opening/closing member 260, the frame fixed portion 264*b*2 fixed to the frame 240, and the hinge pin 264*b*3. Hinge holes (not shown) through which the hinge pin 264*b*3 is inserted are formed on the exterior fixed portion 264*b*1 and on the frame fixed portion 264*b*2. The opening/closing member 260 rotates around the hinge pins 264*a*3 and 264*b*3 as a rotation axis.

In order to ensure that the opening/closing member 260 can be easily assembled, the hinges 264*a* and 264*b* are configured such that the inner diameters of the hinge holes (not shown) are greater than the outer diameters of the hinge pins 264*a*3 and 264*b*3. That is, there is a backlash between the inner surface of the hinge holes (not shown), and the hinge pins 264*a*3 and 264*b*3 in the radial direction. Due to the influence of the backlash and the weight of the opening/closing member 260, the opening/closing member 260 moves downward in the vertical direction and to the side where the center of gravity W of the opening/closing member 260 is located in the horizontal direction with respect to the hinge pins 264*a*3 and 264*b*3. This causes the opening/closing member 260 to tilt so that the side where the center of gravity W is located with reference to the hinges 264*a* and 264*b* in the horizontal direction moves hanging down. That is, as shown in FIG. 7B, the opening/closing member 260 tilts such that its right upper end P1 moves downward.

As shown in FIG. 7B, the moment M1 is generated around the hinges 264*a* and 264*b* due to the weight of the opening/closing member 260. This moment M1 acting on the frame 240 deforms the frame 240 elastically, causing the opening/closing member 260 to tilt such that the side where the center of gravity W is located with reference to the hinges 264*a* and 264*b* in the horizontal direction hangs down. That is, as shown in FIG. 7B, the opening/closing member 260 tilts such that its right upper end P1 moves downward.

In a case where the opening/closing member 260 tilts in this manner, the opening/closing member 260 may interfere or slide with other members when the opening/closing member 260 moves between the open position and the closed position since the positional relationship changes between the opening/closing member 260 and other members including an exterior cover. This may degrade the operability of the opening/closing member 260 and generate abnormal noise.

SUMMARY OF THE INVENTION

An object of the present invention is to provide a sheet conveying apparatus in which a rotating member is rotatably supported by a frame via a hinge and which can suppress the tilting of the rotating member with respect to the frame due to the influence of the weight of the rotating member.

A representative configuration of the present invention is a sheet conveying apparatus, comprising:

a frame;

a conveying member supported by the frame and configured to convey a sheet;

a first hinge;

a second hinge located at a position below the first hinge in a vertical direction; and a rotating member rotatably supported with respect to the frame by the first hinge and the second hinge such that the rotating member is rotatable between a first position where the conveying member is covered and a second position where the conveying member is exposed, wherein the first hinge includes:

a first portion which is fixed to the frame and which includes a first hole portion through which a first hinge pin is inserted; and a second portion which is fixed to the rotating member and which includes:

- a second hole portion through which the first hinge pin is inserted;
- a first engaging hole engaged with a first protrusion formed on the rotating member, the first engaging hole extending in a horizontal direction, and
- a first scale positioned at the edge of the first engaging hole;

wherein the second hinge includes:

a third portion which is fixed to the frame and which includes a third hole portion through which a second hinge pin is inserted; and a fourth portion which is fixed to the rotating member and which includes:

a fourth hole portion through which the second hinge pin is inserted;

a second engaging hole engaged with a second protrusion formed on the rotating member, the second engaging hole extending in the horizontal direction;

a second scale positioned at the edge of the second engaging hole, and wherein, in the horizontal direction, a position where the first portion of the first hinge is arranged is substantially the same as that of the third portion of the second hinge, and the fourth portion of the second hinge is arranged with respect to the second portion of the first hinge such that a center position of the second scale is located at a position farther from a gravity center of the rotating member than a center position of the first scale.

Further features of the present invention will become apparent from the following description of exemplary embodiments with reference to the attached drawings.

DESCRIPTION OF THE EMBODIMENTS

<Image Forming Apparatus>

Hereinafter, the overall configuration of the image forming apparatus 100 including a sheet conveying apparatus according to the present invention will be described together with image forming operations with reference to the drawings. The dimensions, materials, shapes, and relative arrangements of the components described below are not intended to limit the scope of the present invention only to them unless otherwise specified.

Figure 1:
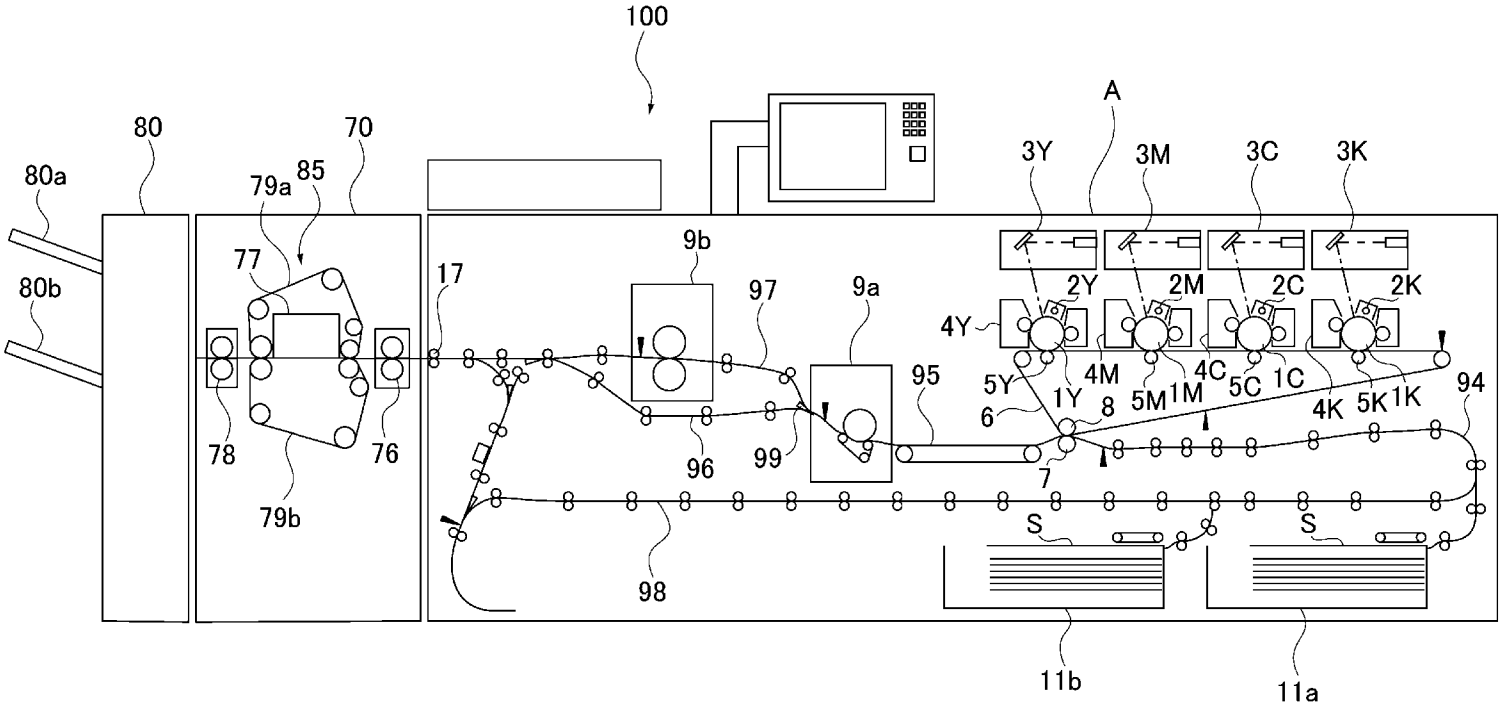
FIG. 1 is a schematic cross-sectional view of an image forming system.

FIG. 1 is a schematic cross-sectional view of the image forming apparatus 100. The image forming system 100 according to the present embodiment includes the image forming apparatus A which forms an image on the sheet S, the cooling apparatus 70 (sheet cooling apparatus) which cools the sheet S, and the post-processing apparatus 80 which performs post-processing on the sheet S. The image forming apparatus A is an intermediate tandem type image forming apparatus in which toners for four colors yellow Y, magenta M, cyan C, and black K are transferred to an intermediate transfer belt, and then the image is transferred to a sheet to form an image. In the following description, the subscripts Y, M, C, and K are generally added to the members that use the toners of respective colors. However, these subscripts are omitted as appropriate unless distinction is required since the configuration and operation of those members are substantially the same as each other except for the difference in color of the toner used.

As shown in FIG. 1, the image forming apparatus A includes an image forming portion which forms an image on the sheet S. The image forming portion includes the photosensitive drums 1 (1Y, 1M, 1C, and 1K), the charging rollers 2 (2Y, 2M, 2C, and 2K), and developing devices 4 (4Y, 4M, 4C, and 4K), the primary transfer rollers 5 (5Y, 5M, 5C, and 5K), the laser scanner unit 3, the intermediate transfer belt 6, the secondary transfer roller 7, and the secondary transfer counter roller 8.

Further, a cooling apparatus 70 for cooling the sheet S is connected to the image forming apparatus A. The cooling apparatus 70 cools the sheet S heated by the fixing apparatus described later. The cooling apparatus 70 includes the receiving roller 76 which receives the sheet S from the image forming apparatus A to convey it, the cooling unit 85 which cools the sheet S, and the discharge roller 78 which discharges the sheet S from the cooling apparatus 70. The cooling unit 85 includes the conveying belts 79*a* and 79*b* for conveying the sheet S, the heat sink 77 made of aluminum which contacts the inner peripheral surface of the conveying belt 79*a*, and a fan (not shown) which cools the heat sink 77 by blowing air. The post-processing apparatus 80 is connected to the cooling apparatus 70. That is, the cooling apparatus 70 is a sheet conveying apparatus which includes the receiving roller 76, the conveying belts 79*a*, 79*b*, and the discharge roller 78 as conveying members for conveying the sheet S. Further, the cooling apparatus 70 is a sheet conveying apparatus which conveys the sheet discharged from the image forming apparatus A to the post-processing apparatus 80 in the image forming system 100.

When an image is formed by the image forming apparatus A, an image forming job signal is first input to a control portion (not shown). As a result, the sheet S stored in the sheet cassettes 11*a* and 11*b* is sent to the conveying path 94. After that, the sheet S passes through the conveying path 94 and is fed to the secondary transfer portion formed by the secondary transfer roller 7 and the secondary transfer counter roller 8.

Meanwhile, in the image forming portion, the surface of the photosensitive drum 1Y is first charged by the charging roller 2Y. After that, the laser scanner unit 3 irradiates the surface of the photosensitive drum 1Y with laser light according to the image data transmitted from an external device (not shown) to form an electrostatic latent image on the surface of the photosensitive drum 1Y. After that, the developing device 4Y attaches the yellow toner to the electrostatic latent image formed on the surface of the photosensitive drum 1Y to form a yellow toner image on the surface of the photosensitive drum 1Y. The toner image formed on the surface of the photosensitive drum 1Y is primarily transferred to the intermediate transfer belt 6 by applying the primary transfer bias to the primary transfer roller 5Y.

By the same process, magenta, cyan, and black toner images are also formed on the photosensitive drums 1M, 1C, and 1K, respectively. Then, by applying a bias to the primary transfer rollers 5M, 5C, and 5K, these toner images are transferred superposedly on the yellow toner image on the intermediate transfer belt 6. As a result, a full-color image is formed on the surface of the intermediate transfer belt 6 in accordance with an image signal.

Thereafter, the full-color toner image is sent to the secondary transfer portion by the intermediate transfer belt 6 which moves while rotating. Then, a secondary transfer bias is applied to the secondary transfer roller 7 at the secondary transfer portion, so that the full-color toner image on the intermediate transfer belt 6 is transferred to the sheet S. The sheet S on which the toner image has been transferred is conveyed to the first fixing apparatus 9*a* by the conveying belt 95, where the sheet S is subjected to a fixing process including heating and pressing. As a result, the toner image on the sheet S is fixed on the sheet S.

After that, the sheet S on which the toner image is fixed is conveyed to the second fixing apparatus 9*b* through the conveying path 97 based on the user's instruction to do so. Then, in the second fixing apparatus 9*b*, a gloss process for adding gloss to the image of the sheet S and a second fixing process for further improving the image fixing property are performed. When a user's instruction to perform the gloss process or the second fixing process is absent, the sheet S which has passed through the first fixing apparatus 9*a* is sent to the conveying path 96. The switching between the conveying paths 96 and 97 is performed by the flapper 99.

Next, when an image formation should be performed on both sides of the sheet S, the sheet S is conveyed to the conveyance path 94 again through the re-conveyance path 98. After that, an image is formed on the back surface of the sheet S in the same manner as the image formation on the front surface of the sheet S described above. Thereafter, the sheet S on which the image is formed is discharged from the image forming apparatus A by the discharge roller 17 and sent to the cooling apparatus 70.

The sheet S sent to the cooling apparatus 70 is conveyed to the cooling unit 85 by the receiving roller 76. Then, in the cooling unit 85, the sheet S is cooled by the heat sink 77 via the conveying belt 79*a*, while being nipped and conveyed by the conveying belts 79*a* and 79*b*. After that, the sheet S is discharged from the cooling apparatus 70 by the discharge roller 78.

Next, the sheet S discharged from the cooling apparatus 70 is sent to the post-processing apparatus 80. Then, in the post-processing apparatus 80, the sheet S is subjected to the sheet processing such as a binding process, an aligning process, and a bookbinding process. After that, the sheet S subjected to the sheet processing is discharged to the discharge tray 80*a* or the discharge tray 80*b*.

<Exterior of Cooling Apparatus>

Next, the configuration of the exterior of the cooling apparatus 70 will be described.

Figure 2:
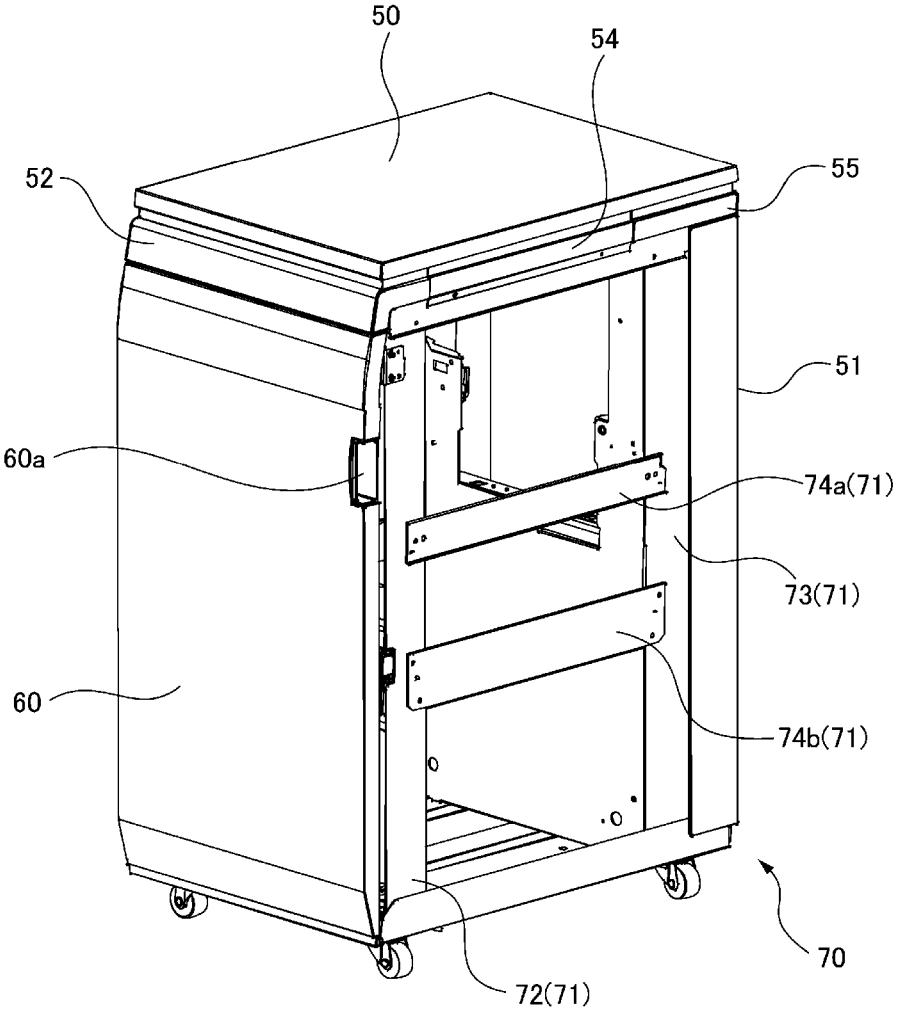
FIG. 2 is a perspective view of the exterior of a cooling apparatus.
Figure 3:
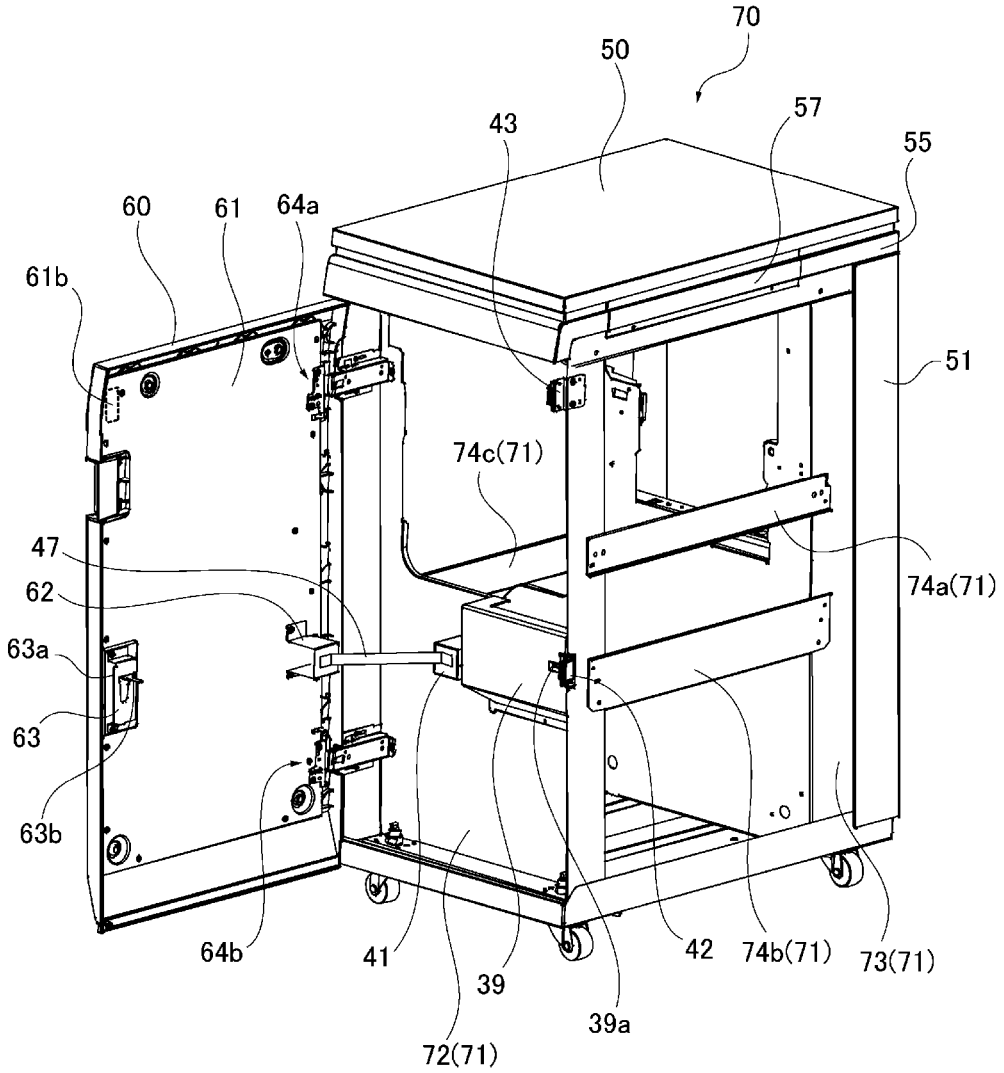
FIG. 3 is a perspective view of the exterior of the cooling apparatus.

FIGS. 2 and 3 are each a diagram showing a perspective view of the exterior of the cooling apparatus 70. FIG. 2 shows a state in which the front surface cover 60, which is a part of the exterior of the cooling apparatus 70, is located in the closed position, whereas FIG. 3 shows a state in which the front surface cover 60 is located in the open position. As shown in FIGS. 2 and 3, the exterior of the cooling apparatus 70 includes the top surface cover 50, the front surface cover 60, the back surface cover 51, the front surface upper cover 52, the side cover 54, and the back surface upper cover 55. These exterior covers are made of resin or metal in this embodiment. In this embodiment, the back surface cover 51 is made of metal and the other exterior covers are made of resin.

The frame body 71 of the cooling apparatus 70, which is made of sheet metal, includes the front side plate 72 which is a front surface side frame, the back side plate 73 which is a back surface side frame, and the stays 74*a* to 74*c*. Both ends of the front side plate 72 and the back side plate 73 are bent substantially in parallel to form a square U-shape. The front side plate 72 and the back side plate 73 support the receiving roller 76, the conveying belts 79*a* and 79*b*, the discharge roller 78, and the cooling unit 85. Further, the stays 74*a* to 74*c* connect the front side plate 72 and the back side plate 73 to reinforce the front side plate 72 and the rear side plate 73. The exterior described above is supported by the frame body 71 of the cooling apparatus 70. An exterior cover is not provided at the sides of the frame body 71 of the cooling apparatus 70 where the stays 74*a* to 74*c* are placed so that the image forming apparatus A and the post-processing apparatus 80 can be connected to these sides. The two side surfaces on which the stays 74*a* to 74*c* are placed are an upstream side surface and a downstream side surface of the sheet conveying apparatus in the cooling apparatus 70.

The front surface cover 60 (rotating member) is rotatably supported by the front side plate 72 of the frame body 71 via hinges 64*a* and 64*b*. The hinge 64*b* (second hinge) is attached below the hinge 64*a* (first hinge) in the vertical direction. The front surface cover 60 is rotated between the closed position (first position) at which the front surface cover 60 covers the receiving roller 76, the conveying belts 79*a* and 79*b*, and the discharge roller 78, which are conveying members for conveying the sheet S, and the open position (second position) at which these members are exposed. When the maintenance process or the jam clearing process for clearing the jam of the sheet S is performed, a user or a service person performs these processes after having moved the front surface cover 60 from the closed position to the open position while holding the handle portion 60*a* of the front surface cover 60.

The metal reinforcing plate 61 for reinforcing the front surface cover 60 is attached to the inside surface of the front surface cover 60. The belt supporting plate 62, the magnet plate 63, and the hinges 64*a* and 64*b* are fixed to the reinforcing plate 61 with screws, respectively. The belt supporting plate 62 holds the stopper belt 47 in cooperation with the belt supporting plate 41 fixed to the front side plate 72. The stopper belt 47 exerts a force on the front surface cover 60 and the front side plate 72 to restrict the rotation of the front surface cover 60 such that the front surface cover 60 located in the open position does not rotate in the direction in which the front surface cover 60 further opens from the open position.

The magnet plate 63 includes the magnetizing portion 63*a* and the flag 63*b* protruding from the magnetizing portion 63*a*. When the front surface cover 60 is located at the closed position, the magnetizing portion 63*a* is fixed by magnetic force to the magnet catch 42 attached to the front side plate 72. Further, when the front surface cover 60 is located at the closed position, the magnetizing portion 61*b* of the reinforcing plate 61 is fixed by magnetic force to the magnet catch 43 attached to the front side plate 72. As a result, the front surface cover 60, which is located at the closed position, is restricted to rotate in the direction to the open position. Furthermore, when the front surface cover 60 is located at the closed position, the flag 63*b* of the magnet plate 63 enters the detection window 39*a* of the detection unit 39 attached to the front side plate 72. As a result, a sensor equipped with the detection unit 39 detects that the front surface cover 60 is located at the closed position.

<Hinges>

The configuration of the hinges 64*a* and 64*b* will be described next.

Figure 4:
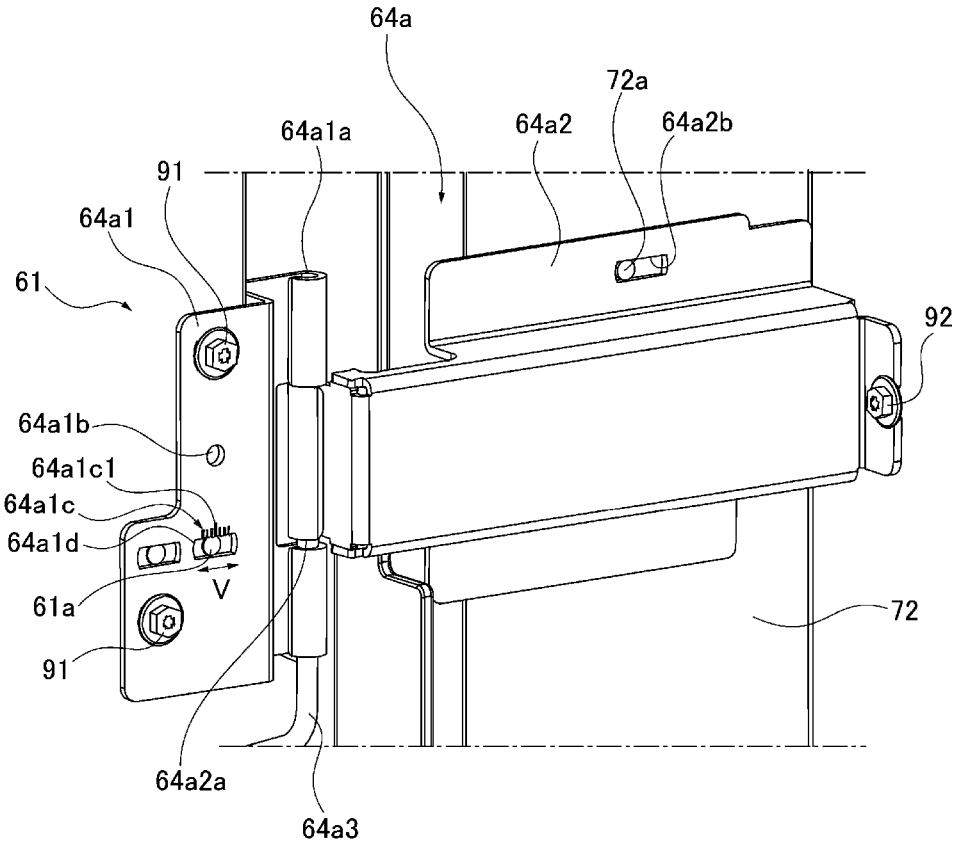
FIG. 4 is an enlarged perspective view of a hinge and its circumference on a front cover.
Figure 5:
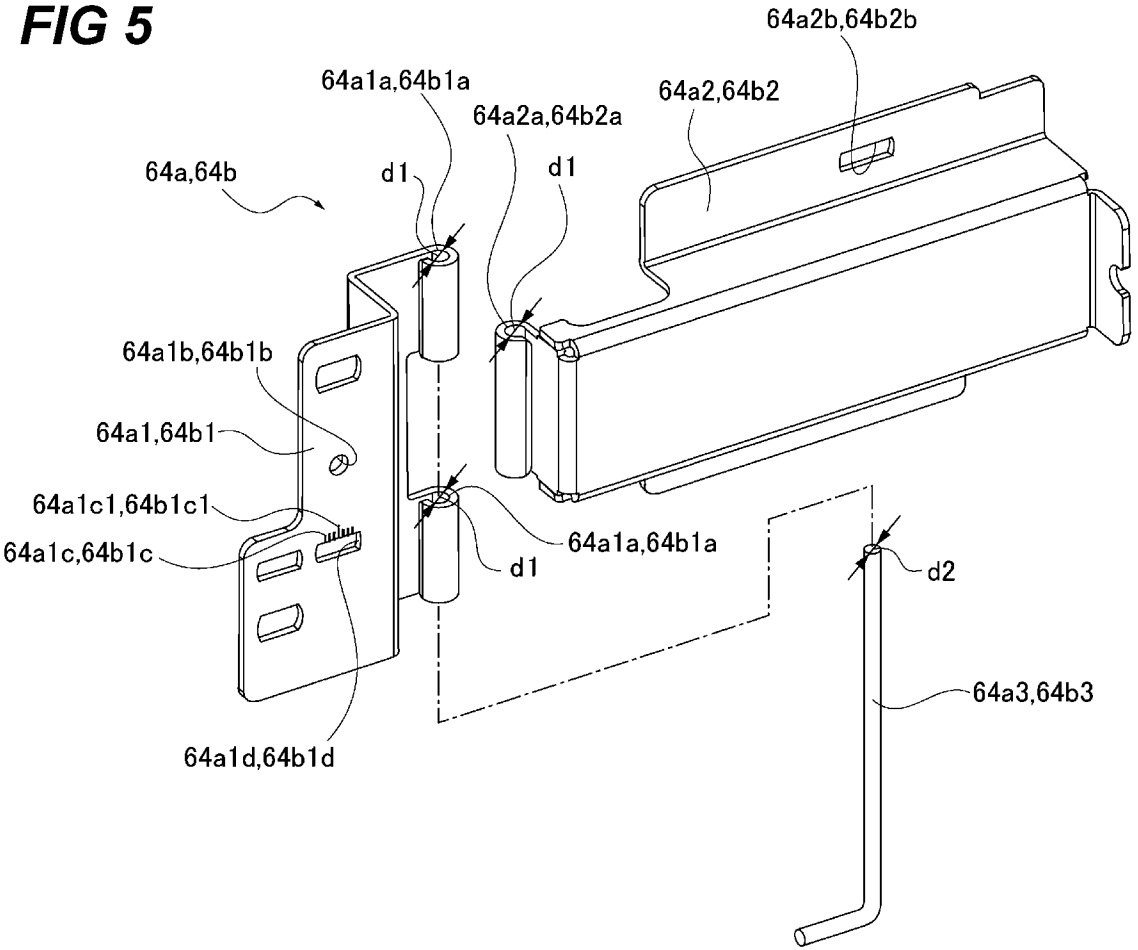
FIG. 5 is an exploded perspective view of the hinge.

FIG. 4 is an enlarged perspective view of the hinge 64*a* and its circumference on the front surface cover 60. FIG. 5 is an exploded perspective view of the hinges 64*a* and 64*b*. The hinges 64*a* and 64*b* are members of substantially the same shape and the reference symbols of the hinges 64*a* and 64*b* are denoted together in FIG. 5. The phrase "substantially the same shape" here denotes the case where the shapes of the hinges 64*a* and 64*b* are completely identical with each other as well as the case where they differ from each other within a tolerance range.

As shown in FIGS. 4 and 5, the hinge 64*a* includes the exterior fixed portion 64*a*1 (second portion) which is fixed to the front surface cover 60 with screws 91, the frame fixed portion 64*a*2 (first portion) which is fixed to the front side plate 72 with screws 92, and the hinge pin 64*a*3 (first hinge pin). The hinge holes 64*a*1*a* (second holes) and the hinge hole 64*a*2*a* (first hole) through which the hinge pin 64*a*3 is inserted are formed on the exterior fixed portion 64*a*1 and the frame fixed portion 64*a*2, respectively.

Similar to the hinge 64*a*, the hinge 64*b* includes the exterior fixed portion 64*b*1 (fourth portion) which is screwed to the front surface cover 60, the frame fixed portion 64*b*2 (third portion) which is screwed to the front side plate 72, and the hinge pin 64*b*3 (second hinge pin). The hinge holes 64*b*1*a* (fourth holes) and the hinge hole 64*b*2*a* (third hole) through which the hinge pin 64*b*3 is inserted are formed on the exterior fixed portion 64*b*1 and the frame fixed portion 64*b*2, respectively.

The hinge pins 64*a*3 and 64*b*3 are each an L-shaped member. After the hinge pin 64*a*3 is inserted into the hinge holes 64*a*1*a* and 64*a*2*a* of the hinge 64*a*, the hinge pin 64*a*3 is rotated by an operator such that the lower end of the hinge pin 64*a*3 faces the reinforcing plate 61. As a result, the lower end of the hinge pin 64*a*3 engages with an engaging hole (not shown) formed on the reinforcing plate 61, so that the hinge pin 64*a*3 is supported by the reinforcing plate 61. Similarly, after the hinge pin 64*b*3 is inserted into the hinge holes 64*b*1*a* and 64*b*2*a* of the hinge 64*b*, the hinge pin 64*b*3 is rotated by an operator such that the lower end of the hinge pin 64*b*3 faces the reinforcing plate 61 to engage with an engaging portion (not shown), so that the hinge pin 64*b*3 is supported by the reinforcing plate 61.

With this configuration, the front surface cover 60 can be rotated around the hinge pins 64*a*3 and 64*b*3. The inner diameter d1 of the hinge holes 64*a*1*a* and 64*a*2*a* is set to be greater than the outer diameter d2 of the hinge pin 64*a*3 in order to ensure workability when inserting the hinge pin 64*a*3. In this embodiment, d1=4.2 mm and d2=4.0 mm. Similarly, the inner diameter d1 of the hinge holes 64*b*1*a* and 64*b*2*a* of the hinge 64*b* is set to be greater than the outer diameter d2 of the hinge pin 64*b*3.

The exterior fixed portion 64*a*1 of the hinge 64*a* includes the positioning hole 64*a*1*b*, the scale 64*a*1*c* (first scale), and the adjusting hole 64*a*1*d* (first engaging hole), which are used to adjust the position of the hinge 64*a*. The adjusting hole 64*a*1*d* is formed at a position below the scale 64*a*1*c* and adjacent to the scale 64*a*1*c* in the vertical direction. The boss 61*a*1 (first protrusion) formed on the reinforcing plate 61 engages with the adjusting hole 64*a*1*d* such that the boss 61*a*1 is horizontally slidable inside the adjusting hole 64*a*1*d*. The position adjustment of the hinge 64*a* is performed as follows.

First of all, at the time of the shipment from the factory, a tool pin is inserted into the positioning hole 64*a*1*b* of the exterior fixed portion 64*a*1 and a hole (not shown) formed on the reinforcing plate 61. As a result, the exterior fixed portion 64*a*1 is positioned with respect to the reinforcing plate 61. Before the shipment of the factory, the hinge 64*a* is assembled such that the boss 61*a*1 is located at the center position 64*a*1*c*1 of the scale 64*a*1*c*. Further, the hinge 64*b* is assembled such that the boss 61*a*2 is located at the center position 64*b*1*c*1 of the scale 64*b*1*c*.

After the shipment from the factory, when the image forming apparatus A or the post-processing apparatus 80 is connected to the cooling apparatus 70, the position adjustment is performed using the scale 64*a*1*c* and the boss 61*a*1 to match the distance and the parallelism between the exterior of the image forming apparatus A or the post-processing apparatus 80 and the front surface cover 60 of the cooling apparatus 70. Specifically, an assembling worker performs the position adjustment while observing how much the boss 61*a*1 is shifted in the V direction shown in FIG. 4 with respect to the center position 64*a*1*c*1 of the scale 64*a*1*c*.

The hinge 64*b* is a member of the same shape as the hinge 64*a*. Thus, the exterior fixed portion 64*b*1 of the hinge 64*b* similarly includes the positioning hole 64*b*1*b*, the scale 64*b*1*c* (second scale), and the adjusting hole 64*b*1*d* (second engaging hole). The adjusting hole 64*b*1*d* is formed at a position below the scale 64*b*1*c* and adjacent to the scale 64*b*1*c* in the vertical direction. The boss 61*a*2 (second protrusion) formed on the reinforcing plate 61 engages with the adjusting hole 64*b*1*d* such that the boss 61*a*2 is horizontally slidable inside the adjusting hole 64*b*1*d*. The position adjustment of the hinge 64*b* with respect to the reinforcing plate 61 is performed similarly as that for the hinge 64*a*.

<Arrangement of the Hinges>

The front surface cover 60 may be supported in a tilted state with respect to the front side plate 72 due to the influence of the weight of the front surface cover 60. Specifically, the front side plate 72 is deformed by the moment around the hinges 64*a* and 64*b* generated by the weight of the front surface cover 60, causing the side of the front surface cover 60 where the center of gravity W (FIG. 6) is located in the horizontal direction to be tilted hanging down with reference to the hinges 64*a* and 64*b*. The backlash in the radial directions between the hinge pins 64*a*3, 64*b*3 and the hinge holes 64*a*1*a*, 64*a*2*a*, 64*b*1*a*, and 64*b*2*a* causes the front surface cover 60 to move with respect to the hinges 64*a* and 64*b*. As a result, the side of the front surface cover 60 where the center of gravity W (FIG. 6) is located in the horizontal direction is tilted hanging down with respect to the hinges 64*a* and 64*b*. That is, the front surface cover 60 tilts such that the position of the right upper end P2 of the front surface cover 60 shown in FIG. 6 moves downward due to the influence of the weight of the front surface cover 60. In contrast, in this embodiment, the arrangement of the hinges 64*a* and 64*b* is changed in advance at the time of shipment from the factory. This suppresses the tilted support of the front surface cover 60 with respect to the front side plate 72 due to the influence of the weight of the front surface cover 60. Further, the tilted support of the front surface cover 60 with respect to the front side plate 72 due to the weight of the front surface cover 60 is suppressed by adjusting the arrangement of the hinges 64*a* and 64*b*. The arrangement of the hinges 64*a* and 64*b* will be described next.

Figure 6B:
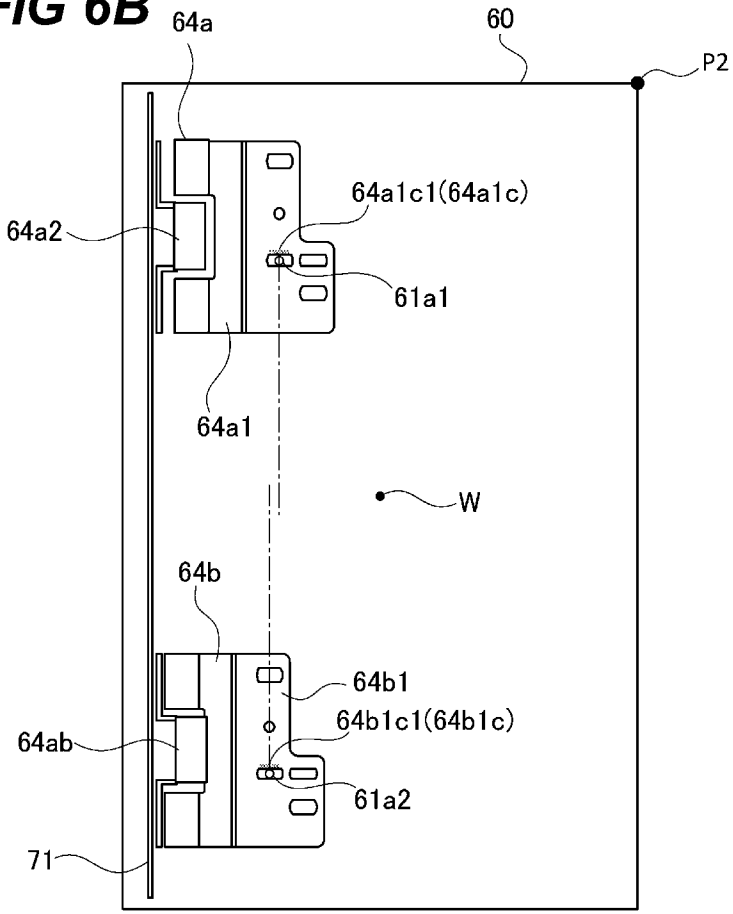
FIGS. 6A and 6B are each a schematic view showing the arrangement of hinges.
Figure 6A:
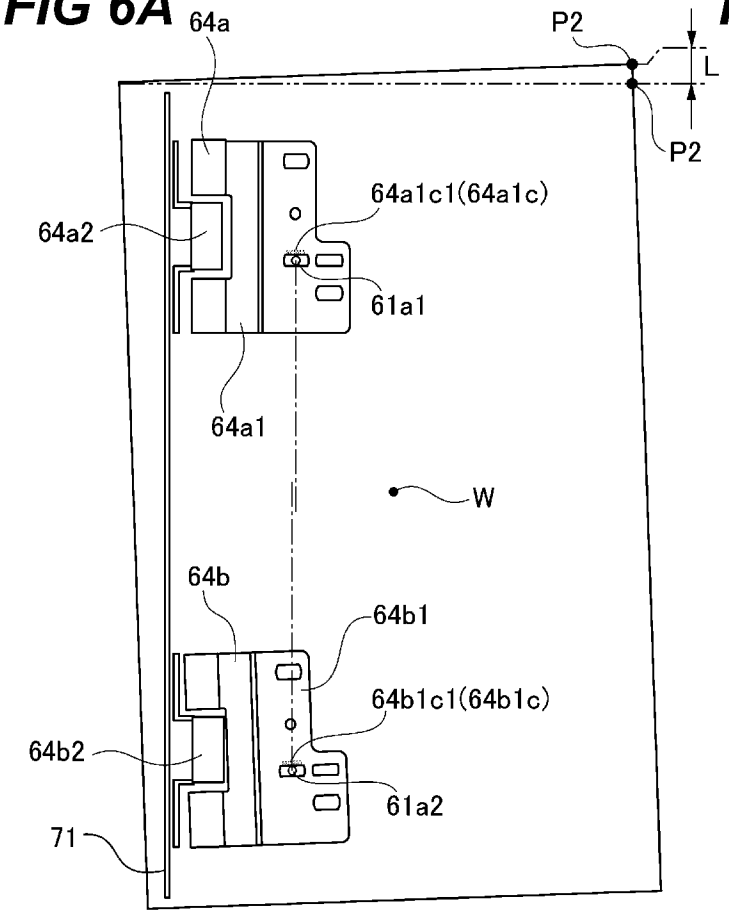
Figure 7B:
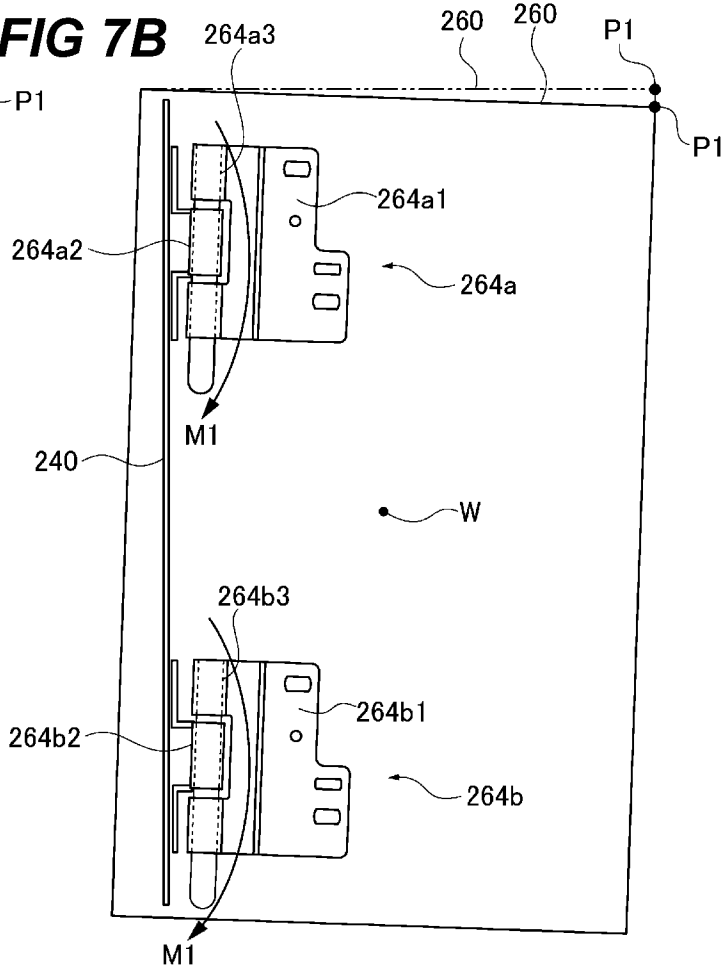
FIGS. 7A and 7B are each a schematic view of an opening/closing member and a frame body.
Figure 7A:
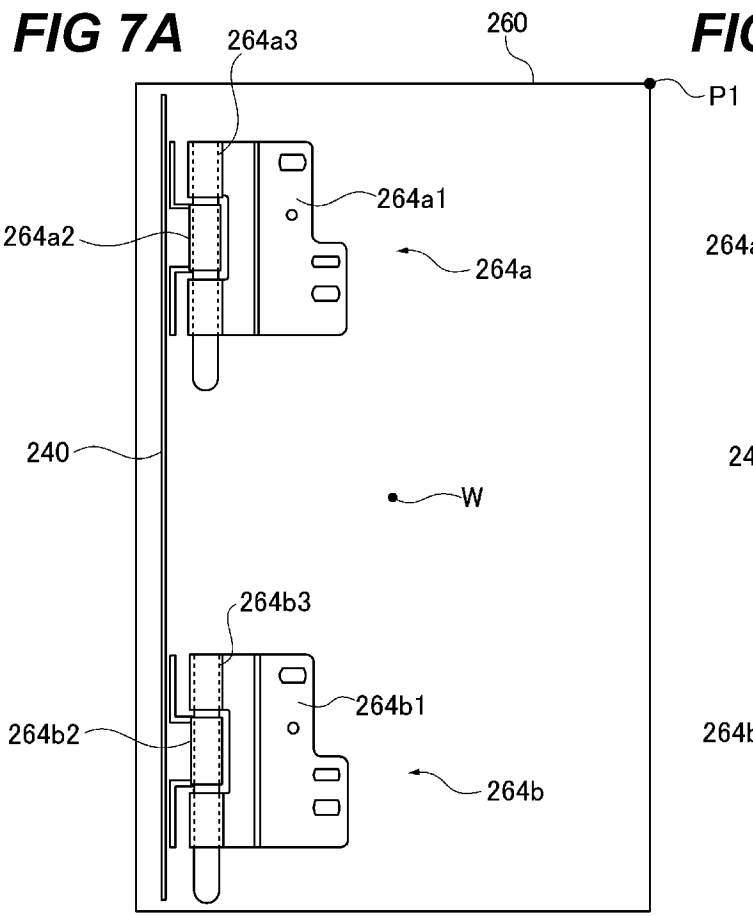

FIGS. 6A and 6B are each a schematic view of the arrangement of hinges 64*a* and 64*b*. FIG. 6A is a diagram in which it is assumed that the weight of the front surface cover 60 is zero. FIG. 6B is a diagram in which the weight of the front surface cover 60 is taken into consideration. In FIGS. 6A and 6B, the front surface cover 60 is located at the closed position.

As shown in FIG. 6A, the position where the frame fixed portion 64*b*2 of the hinge 64*b* is placed and the position where the frame fixed portion 64*a*2 of the hinge 64*a* is placed are substantially the same in the horizontal direction. The phrase "substantially the same" here denotes the case where the positions of the frame fixed portion 64*a*2 and 64*b*2 are completely identical in the horizontal direction as well as the case where they differ within a tolerance range.

The exterior fixed portion 64*b*1 of the hinge 64*b* is located at a position farther from the center of gravity W of the front surface cover 60 in the horizontal direction than the exterior fixed portion 64*a*1 of the hinge 64*a*. As a result, the center position 64*b*1*c*1 of the scale 64*b*1*c* of the hinge 64*b* is located at a position farther from the center of gravity W of the front surface cover 60 in the horizontal direction than the center position 64*a*1*c*1 of the scale 64*a*1*c* of the hinge 64*a*. In the state before the hinge pin 64*b*3 is inserted, the center position of the hinge hole 64*b*2*a* is located at a position farther from the center of gravity W of the front surface cover 60 than the center positions of the hinge holes 64*b*1*a*, the hinge holes 64*a*1*a* of the hinge 64*a*, and the hinge hole 64*a*2*a* of the hinge 64*a*.

By arranging the hinge 64*b* in this way, the front surface cover 60 is tilted such that the right upper end P2 of the front surface cover 60 moves upward when the hinge pin 64*b*3 is inserted into the hinge holes 64*b*1*a* and 64*b*2*a* of the hinge 64*b*. That is, the hinge pin 64*b*3 is inserted into the hinge holes 64*b*1*a* and 64*b*2*a* in the state in which the positions of the hinge holes 64*b*1*a* and 64*b*2*a* of the hinge 64*b* almost overlap with each other in the horizontal direction. The front surface cover 60 is tilted as described above in order to align the horizontal position of the hinge hole 64*b*2*a* of the hinge 64*b* with the horizontal positions of the hinge holes 64*b*1*a*.

Further, as described above, the front surface cover 60 is provided with the reinforcing plate 61. Therefore, the front surface cover 60 is tilted such that the upper right end P2 of the front surface cover 60 moves downward due to the influence of its own weight. By arranging the hinges 64*a* and 64*b* as in this embodiment, the front surface cover 60 tilts to the opposite direction of the tilt caused by the influence of the weight of the front surface cover 60, so that the tilt caused by the influence of the weight of the front surface cover 60 is cancelled. Therefore, as shown in FIG. 6B, it is possible to suppress the tilted support of the front surface cover 60 to the front side plate 72 due to influence of the weight of the front surface cover 60. In other words, by shifting the positions of the hinges 64*a* and 64*b* in the horizontal direction in advance before adjusting the positions of the hinges 64*a* and 64*b*, it is possible to support the front surface cover 60 so as to lift it up despite the front surface cover 60 is going to be tilted by its own weight. This suppresses the tilted support of the front surface cover 60 to the front side plate 72 due to the weight of the front surface cover 60. This suppresses the interference or the slide between the front surface cover 60 and other components due to a change in the positional relationship between them, thereby reducing the lowering of the operability and the generation of abnormal noise, which are accompanied by the interference or the slide.

Here, it is possible to experimentally calculate the vertical downward movement amount R1 of the right upper end P2 of the front surface cover 60 due to the influence of the moment around the hinges 64*a* and 64*b* generated by the weight of the front surface cover 60 from the rigidity of respective members and the weight of the front surface cover 60. It is also possible to experimentally calculate the vertical downward movement amount R2 of the right upper end P2 of the front surface cover 60 due to the influence of the backlash between the hinge pins 64*a*3, 64*b*3 and the hinge holes 64*a*1*a*, 64*a*2*a*, 64*b*1*a*, and 64*b*2*a* from the following parameters. That is, the movement amount R2 can be experimentally calculated from the inner diameter d1 of the hinge holes 64*a*1*a*, 64*a*2*a*, 64*b*1*a*, and 64*b*2*a*, the outer diameter d2 of the hinge pins 64*a*3, and 64*b*3, the vertical distance between the hinges 64*a* and 64*b*, and the horizontal length of the front surface cover 60. Further, let L be the amount of vertical upward movement of the right upper end P2 of the front surface cover 60 which moves when the above-described arrangement of the hinges 64*a* and 64*b* is adopted.

At this time, when the hinges 64*a* and 64*b* are arranged such that L−(R1+R2)=0 is satisfied, the tilt of the front surface cover 60 due to the influence of the weight of the front surface cover 60 can be completely cancelled out. However, it is possible to at least suppress the tilted support of the front surface covey 60 to the front side plate 72 due to the influence of the weight of the front surface cover 60 by setting the movement amount L on the left side of the above equation such that the absolute value of the right side of the above equation becomes small.

As mentioned above, in this embodiment, the positions of the hinges 64*a* and 64*b* can be adjusted by a service person using the scales 64*a*1*c* and 64*b*1*c* when installing the cooling system 70. This makes it possible to adjust the tilt of the front surface cover 60, which varies from apparatus to apparatus due to dimensional tolerances, etc., and to further suppress the tilted support of the front surface cover 60 to the front side plate 72.

In this embodiment, the front surface cover 60 is supported to the frame body 71 by two hinges 64*a* and 64*b*, however the front surface cover 60 can be equipped with the three hinges. When applying the configuration of this embodiment to this case, the horizontal positions of the top hinge and the bottom hinge in the vertical direction are first set. Then, the center hinge is placed on the virtual line connecting the top hinge and the bottom hinge. Even in this case, it is sufficient to arrange the three hinges such that the lower the position of a hinge is in the vertical direction, the farther from the center of gravity W of the front surface cover 60 the position becomes at which the exterior fixed portion of the hinge located. In other words, the exterior fixed portion of the center hinge should be placed at a position farther from the center of gravity W of the front surface cover 60 than the exterior fixed portion of the top hinge in the vertical direction, and the exterior fixed portion of the bottom hinge should be placed a position farther from the center of gravity W of the front surface cover 60 than the exterior fixed portion of the center hinge. Even if three or more hinges are used in this way, the same effects as described above can be obtained by adopting this embodiment.

In this embodiment, the configuration has been described in which the exterior fixed portion 64*b*1 of the hinge 64*b* is located at a position farther from the center of gravity W of the front surface cover 60 in the horizontal direction than the exterior fixed portion 64*a*1 of the hinge 64*a*. However, the same effect can be obtained with the following configuration.

That is, in the horizontal direction, the exterior fixed portion 64*b*1 of the hinge 64*b* is placed at substantially the same position as that of the exterior fixed portion 64*a*1 of the hinge 64*a*. The phrase "substantially the same" here denotes the case where the positions of the exterior fixed portions 64*a*1 and 64*b*1 are completely identical in the horizontal direction as well as the case where they differ from each other within a tolerance range. Also, the frame fixed portion 64*b*2 of the hinge 64*b* is placed at a position closer to the center of gravity W of the front surface cover 60 in the horizontal direction than the frame fixed portion 64*a*2 of the hinge 64*a*. Even with this configuration, the front surface cover 60 is tilted such that the right upper end P2 of the front surface cover 60 moves upward in order to align the hinge holes 64*b*1*a* with the hinge hole 64*b*2*a* when inserting the hinge pin 64*b*3 into the hinge holes 64*b*1*a* and 64*b*2*a* of the hinge 64*b*. Accordingly, the same effects as described above can be obtained.

Although this embodiment describes the configuration in which the hinge pin 64*a*3 of hinge 64*a* and the hinge pin 64*b*3 of hinge 64*b* are separate components, the present invention is not limited to this configuration. Namely, the same effects as described above can be obtained when the hinge pin 64*a*3 of hinge 64*a* and the hinge pin 64*b*3 of hinge 64*b* are integrally formed into a single member.

In this embodiment, the cooling apparatus 70 has been described as an example of the sheet conveying apparatus. However, the present invention is not limited to this configuration, and the same effects described above can be obtained by applying the configuration of the present invention to other apparatuses which convey the sheet S. For example, the same effects as described above can be obtained by applying the configuration of this embodiment to the image forming apparatus A as a sheet conveying apparatus equipped with a conveying roller (conveying member) which conveys the sheet S in the conveying path 94. Further, the same effects as described above can be obtained by applying the configuration of this embodiment to a sheet processing apparatus which is connected to the image forming apparatus A downstream in the sheet conveying direction and which performs a binding process, a folding process, and the like for the sheet S. The same effects as described above can also be obtained by applying the configuration of this embodiment to a reading apparatus having a reading unit which reads an image on the sheet formed by the image forming apparatus A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-094049, filed May 29, 2020, which is hereby incorporated by reference herein in its entirety.

What is claimed is:

1. A sheet conveying apparatus comprising:

a frame;

a conveying member supported by the frame and configured to convey a sheet;

a first hinge;

a second hinge located at a position below the first hinge in a vertical direction; and a rotating member rotatably supported with respect to the frame by the first hinge and the second hinge such that the rotating member is rotatable between a first position where the conveying member is covered and a second position where the conveying member is exposed, wherein the first hinge includes:

a first portion which is fixed to the frame and which includes a first hole portion through which a first hinge pin is inserted; and a second portion which is fixed to the rotating member and which includes:

a second hole portion through which the first hinge pin is inserted;

a first engaging hole engaged with a first protrusion formed on the rotating member, the first engaging hole extending in a horizontal direction, and a first scale positioned at the edge of the first engaging hole;

wherein the second hinge includes:

a third portion which is fixed to the frame and which includes a third hole portion through which a second hinge pin is inserted; and a fourth portion which is fixed to the rotating member and which includes:

a fourth hole portion through which the second hinge pin is inserted;

a second engaging hole engaged with a second protrusion formed on the rotating member, the second engaging hole extending in the horizontal direction;

a second scale positioned at the edge of the second engaging hole, and wherein, in the horizontal direction, a position where the first portion of the first hinge is arranged is substantially the same as that of the third portion of the second hinge such that the first portion of the first hinge overlaps the third portion of the second hinge in the horizontal direction, and the fourth portion of the second hinge is arranged with respect to the second portion of the first hinge such that a center position of the second scale is located at a position farther from a gravity center of the rotating member than a center position of the first scale.

2. The sheet conveying apparatus according to claim 1, wherein the first protrusion is configured to be slidable in the horizontal direction in the first engaging hole, and the second protrusion is configured to be slidable in the horizontal direction in the second engaging hole.

3. A sheet cooling apparatus comprising:

the sheet conveying apparatus according to claim 1, wherein the sheet conveying apparatus includes as the conveying member a first belt and a second belt which forms a nip portion for nipping and conveying a sheet in cooperation with the first belt; and a heat sink which cools the sheet nipped by the nip portion, the heat sink being in contact with an inner circumferential surface of the first belt.

4. An image forming system comprising:

an image forming apparatus which includes an image forming portion configured to form an image on a sheet; and the sheet cooling apparatus according to claim 3, which cools the sheet on which the image is formed by the image forming apparatus.

5. The sheet conveying apparatus according to claim 1, wherein the rotating member includes:

an exterior cover configured as a part of exterior of the image forming apparatus and made of resin; and a reinforcing plate fixed on the exterior cover to reinforce the exterior cover and made of metal, and wherein the first protrusion and the second protrusion are provided on the reinforcing plate.

6. The sheet conveying apparatus according to claim 1, further comprising a third hinge located at a position below the second hinge in a vertical direction;

wherein the third hinge includes:

a fifth portion which is fixed to the frame and which includes a fifth hole portion through which a third hinge pin is inserted; and a sixth portion which is fixed to the rotating member and which includes:

a fifth hole portion through which the third hinge pin is inserted;

a third engaging hole engaged with a third protrusion formed on the rotating member, the third engaging hole extending in the horizontal direction;

a third scale positioned at the edge of the third engaging hole, and wherein, in the horizontal direction, a position where the fifth portion of the third hinge is arranged is substantially the same as that of the third portion of the second hinge such that the third portion of the second hinge is overlap the fifth portion of the third hinge in the horizontal direction, and the sixth portion of the third hinge is arranged with respect to the fourth portion of the second hinge such that a center position of the third scale is located at a position farther from a gravity center of the rotating member than a center position of the second scale.

7. A sheet conveying apparatus comprising:

a frame;

a conveying member supported by the frame and configured to convey a sheet;

a first hinge;

a second hinge located at a position below the first hinge in a vertical direction; and a rotating member rotatably supported with respect to the frame by the first hinge and the second hinge such that the rotating member is rotatable between a first position where the conveying member is covered and a second position where the conveying member is exposed, wherein the first hinge includes:

a first portion which is fixed to the rotating member and which includes a first hole portion through which a first hinge pin is inserted; and a second portion which is fixed to the frame and which includes:

a second hole portion through which the first hinge pin is inserted;

a first engaging hole engaged with a first protrusion formed on the frame, the first engaging hole extending in a horizontal direction, and a first scale positioned at the edge of the first engaging hole;

wherein the second hinge includes:

a third portion which is fixed to the rotating member and which includes a third hole portion through which a second hinge pin is inserted; and a fourth portion which is fixed to the frame and which includes:

a fourth hole portion through which the second hinge pin is inserted;

a second engaging hole engaged with a second protrusion formed on the frame, the second engaging hole extending in the horizontal direction;

a second scale positioned at the edge of the second engaging hole, and wherein, in the horizontal direction, a position where the first portion of the first hinge is arranged is substantially the same as that of the third portion of the second hinge such that the first portion of the first hinge is overlap the third portion of the second hinge in the horizontal direction, and the fourth portion of the second hinge is arranged with respect to the second portion of the first hinge such that a center position of the second scale is located at a position farther from a gravity center of the rotating member than a center position of the first scale.

* * * * *